US005973455A

United States Patent [19]

Mirskiy et al.

[11] Patent Number: 5,973,455

[45] **Date of Patent: *Oct. 26, 1999**

[54] ELECTRONIC BALLAST WITH FILAMENT CUT-OUT

[75] Inventors: Grigoriy Mirskiy, Chicago; William L. Keith, Algonquin; Kent E. Crouse, Hanover Park; Peter W. Shackle, Arlington Hts; Patrick J. Keegan, Schaumburg; Ronald J. Bezdon, Antioch, all of Ill.

[73] Assignee: Energy Savings, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/079,844

[22] Filed: May 15, 1998

[51] Int. Cl.[6] ..... H05B 37/02

[52] U.S. Cl. ..... 315/105; 315/DIG. 7; 315/DIG. 4; 315/219; 315/302; 315/224

[58] Field of Search ..... 315/224, DIG. 7, 315/DIG. 4, 307, 101, 104, 105, 106, 219

[56] References Cited

U.S. PATENT DOCUMENTS

| | | | |
|---|---|---|---|
| 3,769,545 | 10/1973 | Crane | 315/219 |
| 4,562,382 | 12/1985 | Elliott | 315/219 |
| 4,609,850 | 9/1986 | Hanlet | 315/219 |
| 4,677,346 | 6/1987 | Roberts et al. | 315/DIG. 7 |
| 4,682,080 | 7/1987 | Ogawa et al. | 315/106 |
| 4,935,669 | 6/1990 | Nilssen | 315/105 |
| 5,015,923 | 5/1991 | Nilssen | 315/307 |
| 5,027,032 | 6/1991 | Nilssen | 315/103 |
| 5,179,326 | 1/1993 | Nilssen | 315/106 |
| 5,256,939 | 10/1993 | Nilssen | 315/244 |
| 5,656,891 | 8/1997 | Luger et al. | 315/105 |
| 5,726,534 | 3/1998 | Seo | 315/97 |

FOREIGN PATENT DOCUMENTS

| | | | |
|---|---|---|---|
| 2446579 | 9/1980 | France | 315/106 |

OTHER PUBLICATIONS

Joseph D. Greenfield et al. "Using Microprocessors and Micro computers The 6800 Family" John Wiley & Sons,Inc. 1981 p. 10.

*Primary Examiner*—Michael B Shingleton
*Attorney, Agent, or Firm*—Paul F. Wille

[57] ABSTRACT

An electronic ballast for a gas discharge lamp includes an AC to DC converter for changing alternating current at power line voltage to direct current and an inverter powered by the converter and having a series resonant, direct coupled output coupled to the lamp. The inverter includes an AC switch having a diode bridge defining an AC diagonal and a DC diagonal and a transistor connected across the DC diagonal. The primary winding of a filament transformer is connected across the AC diagonal of the bridge and the transistor is coupled to the microprocessor for controlling current through the primary winding. The microprocessor is programmed to close the AC switch while the lamp is starting and to open the switch after the lamp is started, thereby cutting off the filaments from a source of power and reducing the power consumed by the ballast during normal operation. A resistor in series with the transistor is used to detect filament resistance and provide an indication of lamp type.

15 Claims, 3 Drawing Sheets

ELECTRONIC BALLAST WITH FILAMENT CUT-OUT

BACKGROUND OF THE INVENTION

This invention relates to electronic ballasts for gas discharge lamps and, in particular, to an electronic ballast that shuts off filament current after starting.

A fluorescent lamp is an evacuated glass tube with a small amount of mercury in the tube. The tube is lined with an adherent layer of a mixture of phosphors. Some of the mercury vaporizes at the low pressure within the tube and a filament or cathode in each end of the tube is heated to emit electrons into the tube, ionizing the gas. A high voltage between the filaments causes the mercury ions to conduct current, producing a glow discharge that emits ultraviolet light. The ultraviolet light is absorbed by the phosphors and re-emitted as visible light.

A fluorescent lamp is a non-linear load to a power line, i.e. the discharge current through the lamp is not directly proportional to the voltage across the lamp. Current through the lamp is zero until a minimum voltage is reached, then the lamp begins to conduct. Once the lamp conducts, the discharge current will increase rapidly unless there is a ballast in series with the lamp to limit current.

An electronic ballast is a small power supply having the fluorescent lamp as a load. The ballast typically includes a rectifier for converting alternating current (AC) from a power line to direct current (DC) and an inverter for changing the direct current to alternating current at high frequency, typically 25–60 kHz. Some ballasts include a boost circuit between the rectifier and the inverter for increasing the DC voltage, e.g. from approximately 180 volts (assuming a 120 volt input) to 300 volts or more.

There is increasing pressure on the lighting industry and by the lighting industry to improve the efficiency of lighting systems. The converter-inverter stages of a ballast have been refined over the last few years to substantially improve the efficiency of electronic ballasts. Lamp designs have also improved, including the recent introduction of a new family of "T5" lamps. The designation "T5" refers to the diameter of the glass tube of the lamp, as measured in eighths of an inch. In general, a narrower lamp is more efficient than a wider lamp at producing light.

In measuring the efficiency of a lamp, one could consider only the electrical characteristics of the glow discharge relative to the amount of light produced. However, it is the efficiency of the system that must be improved, which means that any power dissipation that does not directly contribute to the production of light must be eliminated or at least reduced. For many fluorescent lamps, including the new T5 lamps, this includes the power dissipated in the filaments. Lamp manufacturers are increasingly specifying a maximum terminal current into a lamp. Such a specification is difficult to meet without removing filament drive when a lamp is operating normally.

When a lamp is started, current is provided to the filaments or heaters in each end of the lamp. The filaments become red hot, which substantially increases the emission of electrons and greatly facilitates starting the lamp. When a lamp is operating normally, the filament current can be reduced and many circuits have been proposed for reducing filament current after a successful start; for example, see U.S. Pat. Nos. 4,935,669; 5,015,923; 5,027,032; 5,179,326; and 5,256,939.

Another problem is that many lamps are dimensionally the same but are electrically quite different. Inevitably, someone will connect the wrong lamp to a ballast. One can provide a ballast that monitors lamp voltage as an indication of lamp type but there are ballasts on the market that can be connected to either one lamp or two lamps (of a particular type). There is a growing expectation in the market that all ballasts can be used with either one lamp or two lamps. Thus, lamp voltage alone is not enough. Further, fault detectors within a ballast must be able to distinguish the absence of a second lamp from a fault condition.

In view of the foregoing, it is therefore an object of the invention to provide an electronic ballast that can distinguish lamp types.

Another object of the invention is to provide a ballast that can be used, without adjustment, for either a single lamp or with two lamps.

A further object of the invention is to distinguish different types of T5 lamps automatically.

Another object of the invention is to provide an electronic ballast that has higher efficiency than electronic ballasts of the prior art.

A further object of the invention is to provide an electronic ballast having a filament cutout circuit that consumes very little power compared to the filaments.

SUMMARY OF THE INVENTION

The foregoing objects are achieved by an electronic ballast including an AC to DC converter for changing alternating current at power line voltage to direct current, an inverter powered by the converter and having a series resonant, direct coupled output adapted to be coupled to the lamp. The inverter includes an AC switch having a diode bridge defining an AC diagonal and a DC diagonal and a transistor connected across the DC diagonal. The primary winding of a filament transformer is connected across the AC diagonal of the bridge and the transistor is coupled to the microprocessor for controlling current through the primary winding. The microprocessor is programmed to close the AC switch while the lamp is starting and to open the AC switch after the lamp is started, thereby cutting off the filaments from a source of power and reducing the power consumed by the system during normal operation.

In a preferred embodiment of the invention, the resonant inductor in the series resonant output includes a secondary winding in series with the AC diagonal of the bridge. In accordance with another aspect of the invention, a resistor in series with the transistor is coupled to an input port of the microprocessor for monitoring filament current. Other inputs enable the microprocessor to monitor lamp voltage and the voltage on the half-bridge capacitor. The various inputs, alone or in combination, enable lamp recognition and close supervision of the inverter by the microprocessor.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
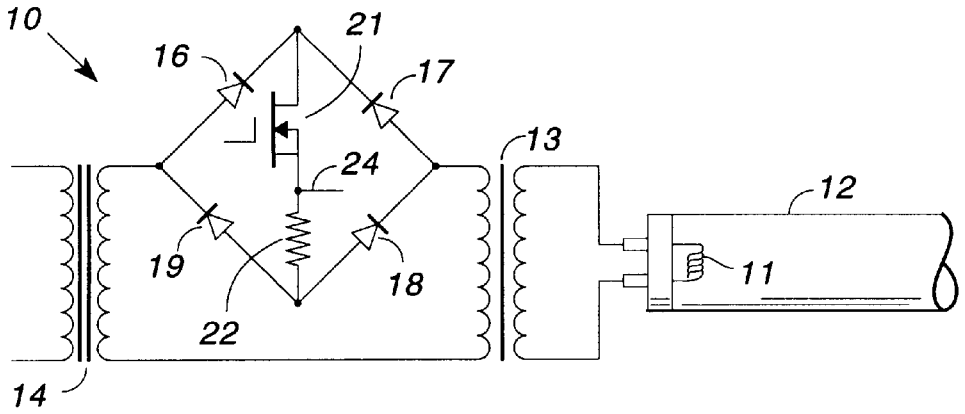
FIG. 1 illustrates an AC switch constructed in accordance with the invention.

FIG. 1 illustrates a portion of a ballast including transformers for supplying heater current to filament 11 enclosed within the left-hand end of lamp 12. The secondary winding of transformer 13 is connected to filament 11 to provide power for heating the filament while lamp 12 is started. The primary winding of transformer 13 is coupled to the secondary winding of transformer 14, the primary winding of which is coupled to a suitable source (not shown) of AC power. In series with the primary winding of transformer 13 is AC switch 10 including diodes 16, 17, 18, and 19 connected in a bridge configuration. The AC diagonal of the bridge is connected in series with the primary winding of transformer 13 and transistor 21 is connected across the DC diagonal of the bridge.

When transistor 21 is conducting, AC power applied to transformer 14 is coupled to transformer 13 through AC switch 10. Specifically, during positive half cycles, current flows through diode 16, transistor 21, and diode 18 to the primary winding of transformer 13. During negative half cycles, current flows through diode 19, transistor 21, and diode 17 from the primary winding of transformer 13. If transistor 21 is biased off, current can flow in neither direction and filament 12 is cut off from a source of power. In this way, transistor 21 controls a bidirectional current through the filament even though the transistor is a unidirectional device.

In accordance with another aspect of the invention, a small resistance, represented by resistor 22, is connected in series with transistor 21 across the DC diagonal of the bridge.

The voltage drop across resistor 22 is proportional to the current through the primary of transformer 13 and, therefore, is proportional to the current through filament 11. In accordance with the invention, the voltage drop across resistor 22 is taken as a measure of the resistance of filament 11 and, therefore, an indicator of lamp type.

Figure 2:
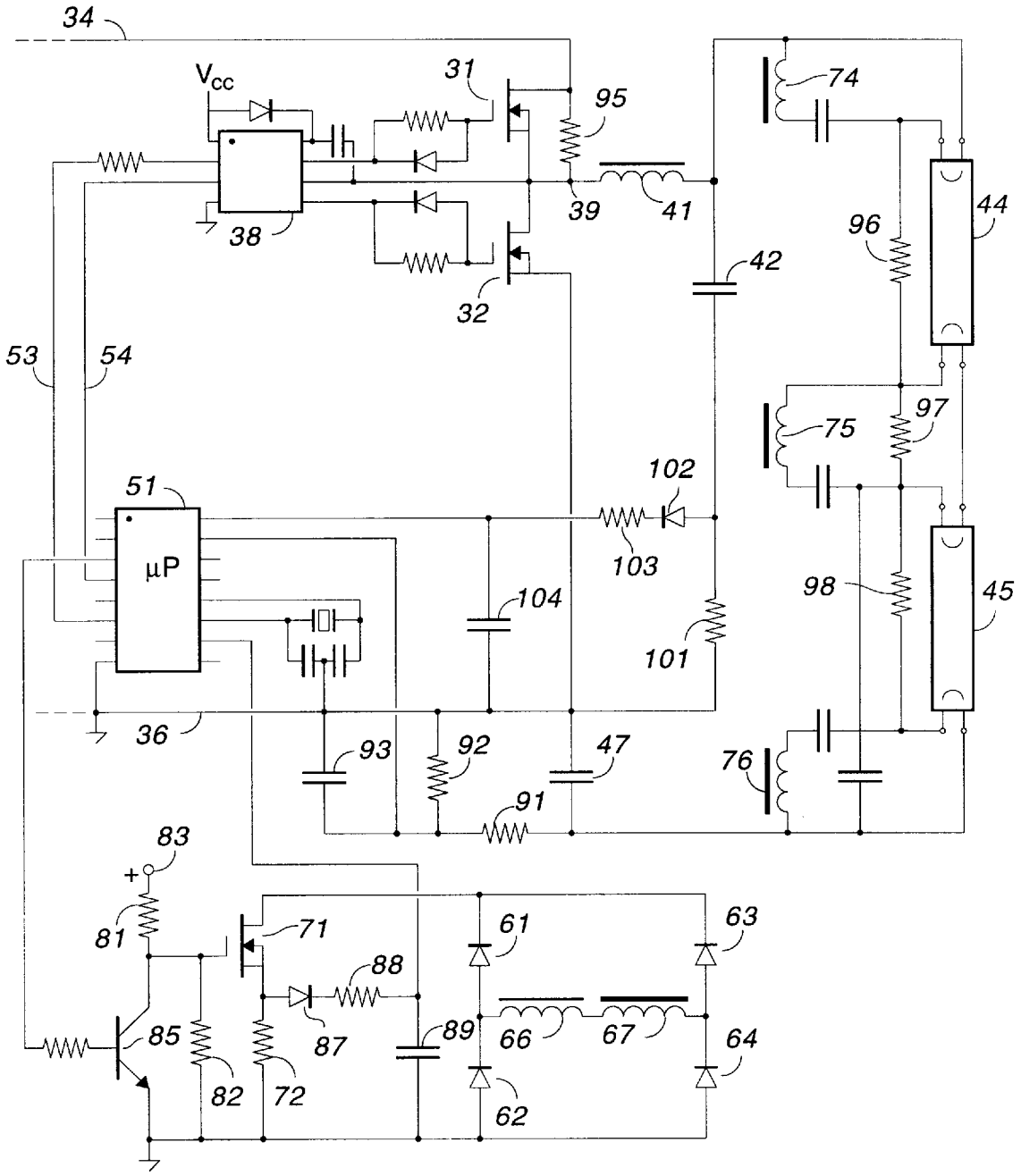
FIG. 2 is a schematic of a portion of an electronic ballast constructed in accordance with the invention.

FIG. 2 is a schematic of the inverter portion of an electronic ballast incorporating an AC switch constructed in accordance with the invention. In FIG. 2, pin one of the integrated circuits is indicated by a small dot and the pins are numbered consecutively counterclockwise. The inverter itself is a type known as a half-bridge inverter having a series resonant, direct coupled output. Transistors 31 and 32 are series connected between high voltage rail 34 and common rail 36, forming a half bridge circuit.

Transistors 31 and 32 conduct alternately under the control of driver circuit 38 to produce a square wave voltage at junction 39. Inductor 41 and capacitor 42 are a series resonant LC circuit that smoothes the pulses into a sinusoidal waveform. Lamp 44 is connected in series with lamp 45 and the two lamps are connected in parallel across resonant capacitor 42 for a direct coupled output. Half bridge capacitor 47 charges to approximately one half the voltage on rail 34 to provide a DC offset that causes the AC through the lamps to be symmetrical about common rail 36.

Driver 38 is controlled by microprocessor 51, which provides a signal on line 53 for controlling the switching frequency of driver 38 and a shutdown signal on line 54. Microprocessor 51 includes a plurality of input/output (I/O) ports, some of which have analog to digital conversion capability. In one embodiment of the invention, microprocessor 51 was a ST62T52 microprocessor as sold by SGS-Thomson Microelectronics and driver 38 was a IR2104 driver circuit as sold by International Rectifier Corporation. Other devices could be used instead.

An AC switch includes diodes 61, 62, 63, and 64 connected in bridge configuration. Windings 66 and 67 are connected in series across the AC diagonal of the bridge and transistor 71 and resistor 72 are connected in series across the DC diagonal of the bridge. The diode bridge is for switching and is not a power supply in any real sense because there is no energy storage, as there would be in a power supply.

Winding 66 is magnetically coupled to resonant inductor 41, acting as the secondary winding of a transformer. Winding 67 is magnetically coupled to inductors 74, 75, and 76, acting as the primary winding of a transformer. Windings 66 and 67 are connected in series and current can flow through both windings only when transistor 71 is conducting. The gate or control electrode of transistor 71 is connected to the junction of resistors 81 and 82, which are series connected between voltage source 83 and common. When power is first applied to the ballast, the voltage from source 83 biases transistor 71 into conduction, thereby enabling current to flow through windings 66 and 67.

Microprocessor 51 is programmed to cause driver 38 to operate at high frequency initially, e.g. 70 kilohertz, thereby causing a relatively large voltage drop across inductor 41 and a relatively large current to flow through inductors 74, 75, and 76. After a predetermined period, the switching frequency is reduced, e.g. to 30 kilohertz, which is slightly above the resonant frequency of inductor 41 and capacitor 42. This change in frequency reduces the current through the filaments and would have sufficed in the past to reduce the amount of power dissipated by the ballast. In accordance with the invention, microprocessor 51 turns on transistor 85, thereby reducing the gate voltage on transistor 71 and turning off transistor 71. With transistor 71 non-conducting, the filament drive current is zero. The amount of current necessary to maintain transistor 85 conducting is insignificant, e.g. one milliampere.

In accordance with another aspect of the invention, resistor 72 is used to monitor current through the primary of the filament drive transformer and to distinguish one type of lamp from another. For example, the two T5 types lamps are quite different electrically. The maximum current through a high efficiency T5 lamp is 170 ma. and the lamp has a cold filament resistance of approximately 9 ohms. The maximum current through a high output T5 lamp is 460 ma. and the lamp has a cold filament resistance of 1.7–3.5 ohms. Other lamps have different characteristics.

The voltage across resistor 72 is rectified by diode 87, filtered by RC network 88, 89 and coupled to pin ten of microprocessor 51. This pin has analog to digital conversion capability and the microprocessor converts the voltage to a digital value. This value is then used to determine the type of lamp attached to the ballast, e.g. from a look-up table stored in memory in microprocessor 51.

When the type of lamp is determined, microprocessor 51 adjusts the frequency of operation to produce the proper voltage and current for the particular lamp. In addition, parameters defining various failure modes, e.g. end of life, rectification, are also selected for the particular type of lamp. Frequency data and other parameters are also stored in look-up tables in the memory of microprocessor 51. If data corresponding to the conditions seen by microprocessor 51 is not found, or if the chosen frequency does not produce the expected voltage and current, the microprocessor is programmed to shut down the ballast, i.e. reduce the output voltage to a low value and periodically check to see if the situation has been corrected.

In accordance with a further aspect of the invention, microprocessor 51 has additional inputs for identification of lamps and for monitoring lamp operation. Resistors 91 and 92 divide the voltage across half bridge capacitor 47 and the fraction, filtered by resistor 92 and capacitor 93 is coupled to pin fifteen of microprocessor 51. Resistors 95, 96, 97, and 98 provide a DC path for charging half bridge capacitor 47 whether two lamps are connected to the ballast or one lamp is connected to the ballast (using the upper and lower terminals only). The voltage is measured by microprocessor 51 and a decision is made as to whether or not all filaments are intact and, if so, how many lamps are connected to the ballast. The appropriate filament resistance is then determined for one lamp or two lamps and the filament resistance is measured, as previously described.

In the same manner, lamp voltage is measured by monitoring the voltage across resistor 101 in series with resonant capacitor 42. The voltage is rectified by diode 102, filtered by resistor 103 and capacitor 104, and coupled to pin sixteen of microprocessor 51. Lamps having distinctly different operation voltages are distinguished by this test alone, otherwise lamp voltage is combined with other tests to uniquely identify a lamp. A failure to identify a lamp causes the stored program to default to routine for shutting down the ballast.

Figure 3:
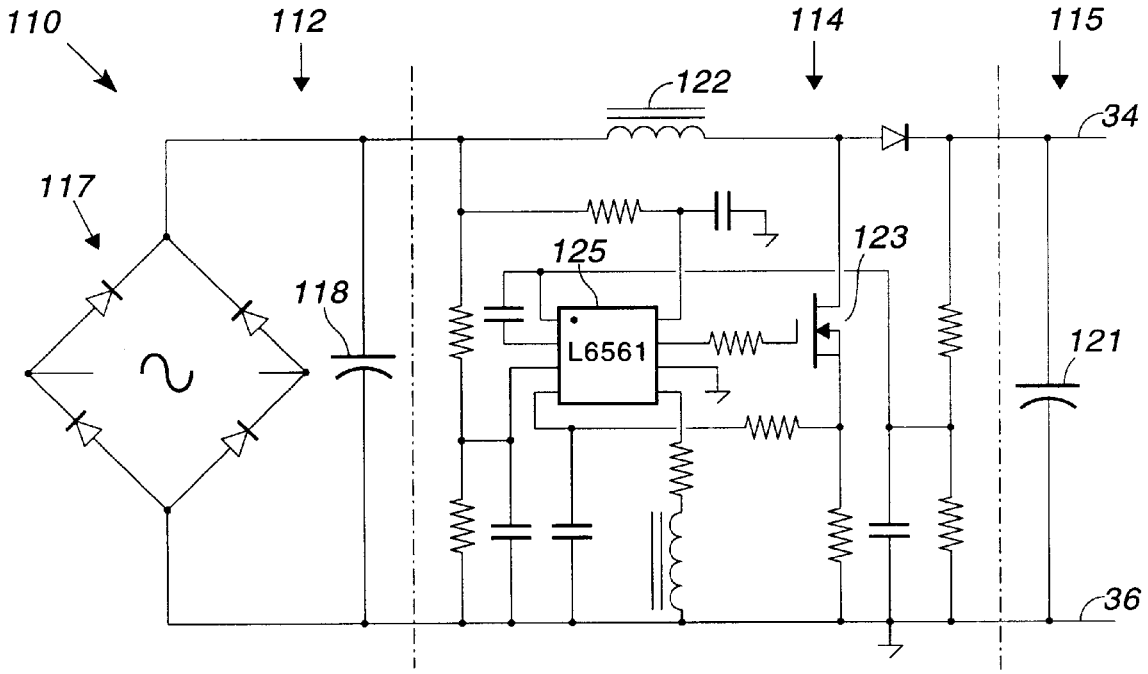
FIG. 3 is a schematic of the AC to DC conversion portion of an electronic ballast.

FIG. 3 is a schematic of the AC to DC converter portion of an electronic ballast. Converter 110 includes rectifier section 121, boost circuit 114, and energy storage section 115. Rectifier section 112 includes diode bridge 117 for charging storage capacitor 118. The voltage on capacitor 118 is increased and stored in bulk capacitor 121 by boost circuit 114 including inductor 122 and transistor 123 driven by boost controller 125. The terminals of bulk capacitor 121 are connected to high voltage rail 34 and common rail 36 in FIG. 2. In one embodiment of the invention, controller 125 was implemented as an L6561 power factor correction circuit as sold by SGS-Thomson Microelectronics. The circuit of FIG. 3 is essentially the same as the circuit recommended in the data sheets accompanying the L6561 integrated circuit.

Figure 4:
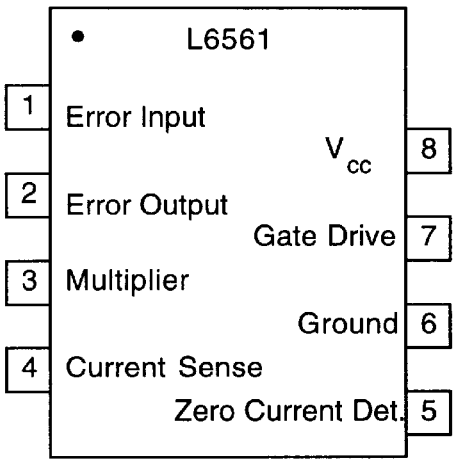
FIG. 4 (PRIOR ART)
FIG. 4 is a diagram of the pin designations of an integrated circuit that can be used to implement the invention.
Figure 5:
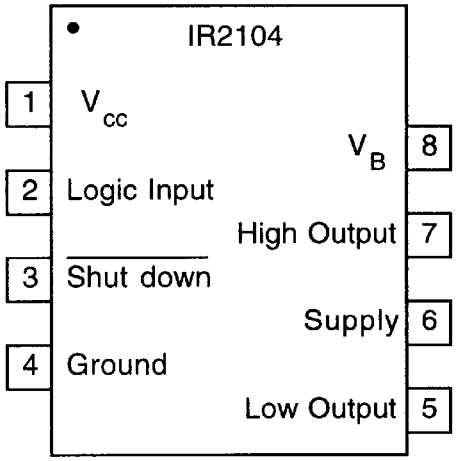
FIG. 5 (PRIOR ART)
FIG. 5 is a diagram of the pin designations of an integrated circuit that can be used to implement the invention.
Figure 6:
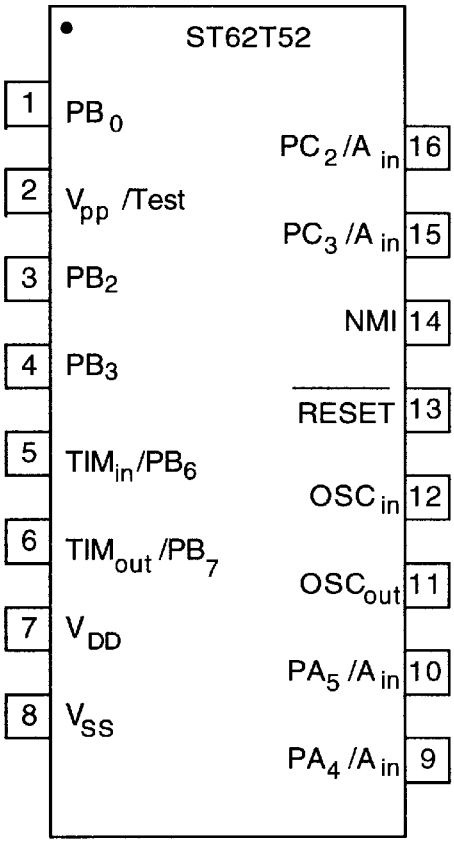
FIG. 6 (PRIOR ART)
FIG. 6 is a diagram of the pin designations of an integrated circuit that can be used to implement the invention.

FIG. 4 illustrates the pin designations of the L6561 device, FIG. 5 illustrates the pin designations of the IR2104 device, and FIG. 6 illustrates the pin designations of the ST62T52 microprocessor. These figures are provided as a convenience in understanding FIGS. 2 and 3.

The invention thus provides electronic ballast that can automatically distinguish lamp types, particularly different types of T5 lamps, and can operate, without adjustment, either one lamp or two lamps. The ballast operates at higher efficiency than electronic ballasts of the prior art by removing filament drive after starting and by having a filament cutout circuit that consumes very little power.

It is understood that filament resistance is not measured directly or precisely. Filament resistance, lamp voltage, lamp current, and other parameters do not have fixed values. A number obtained by the microprocessor is accepted as valid if it is within a predetermined range of values and that range, in turn, may depend upon other parameters; e.g. operating time, drive frequency, or temperature. Despite the variations that can occur while starting and operating a gas discharge lamp, the measurements are effective and provide a reliable mechanism for distinguishing types of lamps and for operating lamps efficiently.

Having thus described the invention, it will be apparent to those of skill in the art that many modifications can be made with the scope of the invention. For example, other forms of AC switch can be used, such as a relay, provided that the device can be controlled by a microprocessor. A current transformer can be substituted for resistors 22, 72 in the AC switch. The power for the filament drive transformer can be derived from the boost circuit; e.g. magnetically coupling secondary 66 to inductor 115 instead of inductor 41. Microprocessor 51 need not handle all timing or control functions. Some functions can be implemented in analog form.

What is claimed is:

1. An electronic ballast comprising:

a high voltage rail and a common rail;

a pair of switching transistors coupled in series between said high voltage rail and said common rail and having a junction therebetween;

an inductor and a capacitor coupled in series between said junction and one of the rails to form a series resonant circuit;

a transformer including said inductor as a primary winding and further including a secondary winding;

a filament transformer including a first winding and a second winding;

an AC switch;

wherein said secondary winding, said first winding, and said AC switch are connected in series, whereby said AC switch controls the flow of current through said first winding from said secondary winding.

2. The ballast as set forth in claim 1 wherein said AC switch includes four diodes coupled in bridge configuration having an AC diagonal and a DC diagonal;

a transistor connected across said DC diagonal; and said first winding and said secondary winding are connected in series across said AC diagonal.

3. The ballast as set forth in claim 2 and further including a microprocessor coupled to said transistor for controlling the current through said first winding.

4. The ballast as set forth in claim 2 wherein said ballast further includes a resistor coupled in series with said transistor across said DC diagonal.

5. The ballast as set forth in claim 4 and further including an analog to digital converter coupled to said resistor for converting a voltage drop across said resistor into a digitial representation of the resistance of the filaments coupled to said filament transformer.

6. A method for operating an electronic ballast controlled by a microprocessor, said method comprising the steps of:

determining the approximate resistance of a lamp filament coupled to the ballast;

if the resistance matches data stored in the microprocessor, then starting the lamp;

else entering a default routine.

7. The method as set forth in claim 6 wherein said determining step is preceded by the steps of:

determining filament continuity;

if continuous filaments are found, then executing the determining step;

else entering the default routine.

8. The method as set forth in claim 6 wherein said determining step includes the step of:

obtaining data representative of the resistance of the lamp filament as filament data;

comparing the filament data with data representative of a first type of lamp; and if the data does not match, then comparing the filament data with data representative of a second type of lamp.

9. The method as set forth in claim 6 wherein said starting step includes the steps of:

heating the filaments of the lamp;

applying a starting voltage to the lamp;

turning off the filaments; and applying an operating voltage to the lamp.

10. The method as set forth in claim 9 wherein said starting step further includes the steps of:

monitoring the operation of the lamp;

if the operation is within predetermined parameters as represented by data stored in the microprocessor, then continuing to apply the operating voltage to the lamp;

else terminating the operating voltage and entering the default routine.

11. The method as set forth in claim 10 wherein said default routine includes the step of:

periodically attempting to restart the lamp.

12. A method for operating an electronic ballast controlled by a microprocessor, said method comprising the steps of:

determining the approximate resistance of a lamp filament coupled to the ballast;

if the resistance matches data stored in the microprocessor, then starting the lamp;

else entering a default routine;

supplying a discharge current to the lamp in accordance with matching data stored in the microprocessor.

13. The method as set forth in claim 12 wherein the ballast includes a variable frequency inverter having a series resonant, direct coupled output and said supplying step includes the step of:

operating the inverter at a frequency in accordance with matching data stored in the microprocessor.

14. The method as set forth in claim 12 wherein said starting step includes the step of:

applying a current through the filament to heat the filament.

15. The method as set forth in claim 14 wherein said supplying step includes the step of:

terminating the current through the filament to reduce the power consumed by the electronic ballast.

* * * * *